US009239542B2

(12) United States Patent
Kasai et al.

(10) Patent No.: US 9,239,542 B2
(45) Date of Patent: Jan. 19, 2016

(54) IMAGE FORMING APPARATUS

(71) Applicants: Tadashi Kasai, Kanagawa (JP); Makoto Yasuda, Kanagawa (JP); Mutsuki Morinaga, Kanagawa (JP); Hitoshi Yamamoto, Kanagawa (JP); Emiko Shiraishi, Tokyo (JP); Yuichi Aizawa, Ibaraki (JP)

(72) Inventors: Tadashi Kasai, Kanagawa (JP); Makoto Yasuda, Kanagawa (JP); Mutsuki Morinaga, Kanagawa (JP); Hitoshi Yamamoto, Kanagawa (JP); Emiko Shiraishi, Tokyo (JP); Yuichi Aizawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/325,809

(22) Filed: Jul. 8, 2014

(65) Prior Publication Data

US 2015/0050033 A1 Feb. 19, 2015

(30) Foreign Application Priority Data

Aug. 16, 2013 (JP) ..... 2013-169123

(51) Int. Cl.
*G03G 15/08* (2006.01)
*G03G 15/00* (2006.01)

(52) U.S. Cl.
CPC ..... *G03G 15/0863* (2013.01); *G03G 15/0879* (2013.01); *G03G 15/6585* (2013.01)

(58) Field of Classification Search
USPC ..... 399/12
See application file for complete search history.

(56) References Cited

U.S. PATENT DOCUMENTS

| | | | | |
|---|---|---|---|---|
| 5,182,600 | A * | 1/1993 | Hasegawa et al. | 399/74 |
| 2006/0002743 | A1* | 1/2006 | Katsuyama et al. | 399/258 |
| 2008/0145071 | A1* | 6/2008 | Ogasawara | 399/28 |
| 2008/0175628 | A1* | 7/2008 | Kita et al. | 399/262 |
| 2010/0119264 | A1* | 5/2010 | Yamaguchi et al. | 399/262 |
| 2010/0209122 | A1* | 8/2010 | Ishino | 399/12 |
| 2011/0093702 | A1* | 4/2011 | Eom et al. | 713/168 |
| 2012/0099878 | A1* | 4/2012 | Sukesako et al. | 399/27 |
| 2012/0154830 | A1* | 6/2012 | Robinson et al. | 358/1.9 |
| 2012/0243887 | A1* | 9/2012 | Murata et al. | 399/27 |
| 2012/0321341 | A1* | 12/2012 | Hori et al. | 399/110 |
| 2012/0321362 | A1* | 12/2012 | Hirota | 399/341 |
| 2013/0011777 | A1* | 1/2013 | Aoki et al. | 430/105 |
| 2013/0028617 | A1* | 1/2013 | Fukuoka et al. | 399/27 |
| 2013/0028619 | A1 | 1/2013 | Terao et al. | |
| 2013/0028620 | A1 | 1/2013 | Terao et al. | |
| 2013/0101303 | A1 | 4/2013 | Kasai et al. | |
| 2013/0148993 | A1 | 6/2013 | Aoki et al. | |

(Continued)

FOREIGN PATENT DOCUMENTS

| | | |
|---|---|---|
| JP | 2008-102478 | 5/2008 |
| JP | 2008-151971 | 7/2008 |
| JP | 2011-141423 | 7/2011 |

OTHER PUBLICATIONS

U.S. Appl. No. 14/325,894, filed Jul. 8, 2014, Shiraishi, et al.

(Continued)

*Primary Examiner* — Clayton E LaBalle
*Assistant Examiner* — Linda B Smith
(74) *Attorney, Agent, or Firm* — Oblon, McClelland, Maier & Neustadt, L.L.P.

(57) ABSTRACT

An image forming apparatus includes a plurality of image forming stations, each including a developing device, a toner container containing a colored or special toner, and a replaceable supply-toner conduit extending from the toner container to the developing device; and a toner type identifier to identify a type of toner used in the supply-toner conduit of each of the plurality of image forming stations.

13 Claims, 12 Drawing Sheets

(56) References Cited

U.S. PATENT DOCUMENTS

2013/0278943 A1 10/2013 Kurosawa et al.
2013/0342859 A1 12/2013 Kasai et al.

OTHER PUBLICATIONS

U.S. Appl. No. 14/325,894, filed Jul. 8, 2014.

* cited by examiner

IMAGE FORMING APPARATUS

CROSS-REFERENCE TO RELATED APPLICATION

This patent application is based on and claims priority pursuant to 35 U.S.C. §119(a) to Japanese Patent Application No. 2013-169123, filed on Aug. 16, 2013 in the Japan Patent Office, the entire disclosure of which is incorporated by reference herein.

BACKGROUND OF THE INVENTION

1. Technical Field

Embodiments of the present invention relates to an image forming apparatus employing electrophotography.

2. Related Art

In current image forming apparatuses employing the electrophotographic method, some can use a special toner other than so-called CMYK process color toners processing colors of cyan (C), magenta (M), yellow (Y), and black (K). Such an image forming apparatus is configured such that either an image forming station for the special toner is included in addition to the four CMYK image forming stations or the image forming station for one of the process color toners is used for the special toner.

One of the examples of the special toner includes clear toner, as also called transparent toner, colorless toner, achromatic color, pigment-less toner, and the like. The clear toner is overlaid on part or all of the colored printed matter and the gloss adjusted thereby, thereby creating high value-added printed matter.

Other examples of special toner include red (R) toner, green (G) toner, and blue (B) toner. Use of those colors enables high quality reproduction of colors that cannot be reproduced using only the CMYK process color toners. There are many types of special colors other than the above.

In using the above special toner, there are cases in which a user replaces the toner of the image forming station of the image forming apparatus. One case is that the user replaces the process color toner with the special toner, and the other case is that the user replaces the special toner with the process color toner, or otherwise, from one type of special toner to another type of special toner, and from one process color toner to another process color toner. In the replacement of different types of toner, undue contamination occurs due to the mixing of colors caused by the replacement of different types of toner. Further, there is a possibility that an abnormal image is produced or the image forming unit is damaged.

To cope with such a problem, some image forming apparatuses can produce an image by overlaying color toner images including the special color in a desired order to form a color image, by replacing CMYK toner cartridges with a cartridge of the special color. Such image forming apparatuses are configured such that the image formation is enabled by overlaying the color toner images including an image of the special toner in the desired order by simply replacing the CMYK toner cartridges with the special color toner cartridge; however, color mixing of the different types of toner due to human error that replaces the toner cannot be prevented.

SUMMARY

In one embodiment of the disclosure, there is provided an image forming apparatus including a plurality of image forming stations, each including a developing device, a toner container containing a colored or special toner, and a replaceable supply-toner conduit extending from the toner container to the developing device; and a toner type identifier to identify a type of toner used in the supply-toner conduit of each of the plurality of image forming stations.

These and other objects, features, and advantages of the present invention will become apparent upon consideration of the following description of preferred embodiments of the present invention when taken in conjunction with the accompanying drawings.

DETAILED DESCRIPTION

Hereinafter, preferred embodiments of the present invention will be described with reference to accompanying drawings.

Figure 1:
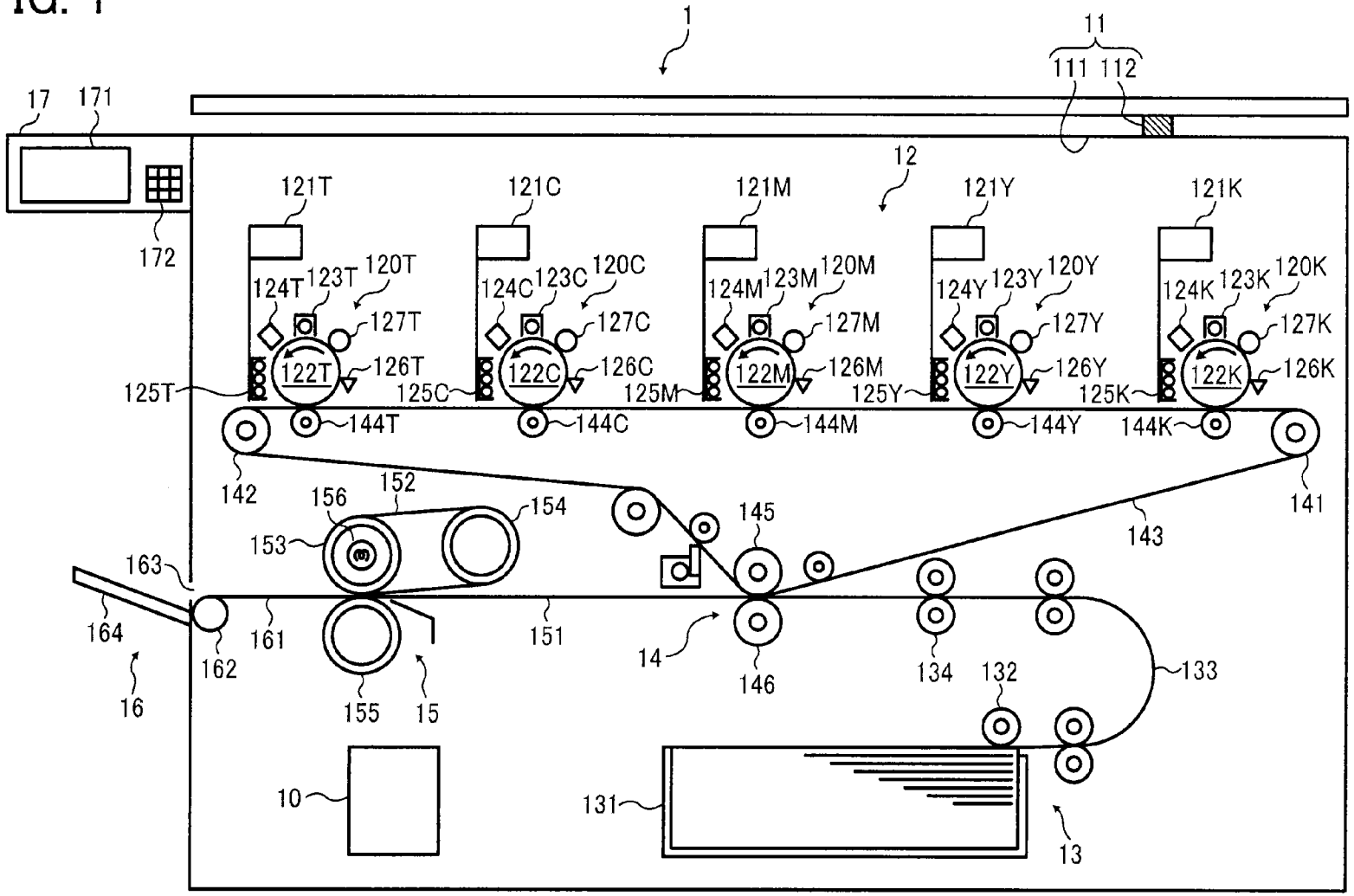
FIG. 1 is a cross-sectional view schematically illustrating an image forming apparatus to implement an embodiment of the present invention.
Figure 2:
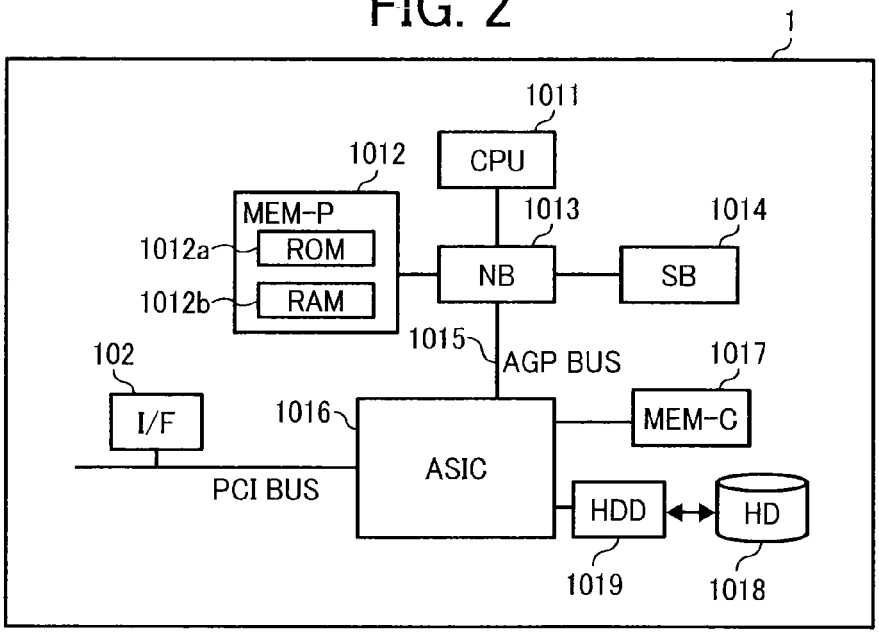
FIG. 2 is a block diagram illustrating a structure of a control circuit included in the image forming apparatus.

FIG. 1 is a cross-sectional view of a color printer as an example of image forming apparatus according to an embodiment of the present invention. FIG. 2 is a block diagram illustrating a structure of a control circuit included in the image forming apparatus.

As illustrated in FIGS. 1 and 2, the image forming apparatus 1 forms an image on a sheet of paper as a recording medium by fixing a toner image onto the recording medium. As illustrated in FIG. 1, the image forming apparatus 1 includes a control circuit portion 10, an image reader 11, an image forming portion 12, a sheet feeder portion 13, a transfer portion 14, a fixing portion 15, a discharging portion 16, and a console 17.

The control circuit portion 10 includes, as illustrated in FIG. 2, a Central Processing Unit (CPU) 1011, a main memory (MEM-P) 1012, a north bridge (NB) 1013, a south bridge (SB) 1014, an Accelerated Graphic Port (AGP) bus 1015, an Application Specific Integrated Circuit (ASIC) 1016, a local memory (MEM-C) 1017, a hard disk (HD) 1018, a hard disk drive (HDD) 1019, and a network I/F 102.

The main memory 1012 stores programs and the CPU 1011 modifies or calculates data and controls on operations performed by the image reader 11, the image forming portion 12, the sheet feeder portion 13, the transfer portion 14, the fixing portion 15, and the discharging portion 16 according to the programs stored. The main memory 1012 serves as a memory area of the control circuit portion 10 and includes a Read Only Memory (ROM) 1012*a*, and a Random Access Memory (RAM) 1012*b*. The ROM 1012*a* stores programs and data to cause each device of the control circuit portion 10 to work. The program stored in the ROM 1012*a* can be recorded in computer readable recording media such as a CD-ROM, a flexible disk (FD), a CD-rewritable, and a Digital Versatile Disc (DVD) in the installable format or the executable format and can be offered.

The RAM 1012*b* is used as working memory when reading out programs and data and as a drawing memory when printing data stored in memory. NB 1013 is a bridge to connect the CPU 1011 with the MEM-P 1012, SB 1014, and AGP-bus 1015. The SB 1014 is a bridge to connect the NB 1013 with a Peripheral Component Interconnect (PCI) bus and other peripheral devices. The AGP bus 1015 is a bus interface for a graphic accelerator card proposed to speed up the graphics operation.

The ASIC 1016 includes a PCI target and an AGP master, an arbiter (ARB) as a core of the ASIC 1016, a memory control circuit to control the MEM-C 1017, a plurality of Direct Memory Access Controller (DMAC) to rotate image data using hardware logic. The ASIC 1016 is connected to a Universal Serial Bus (USB) interface or Institute of Electrical and Electronics Engineers (IEEE) 1394 interface via the PCI bus.

The MEM-C 1017 is a local memory used as an image buffer and code buffer for copying. The HD 1018 is nonvolatile storage to store image data, font data used for printing, and various formats. The HDD 1019 controls reading and writing data of the HD 1018 under the control of the CPU 1011.

A network interface (I/F) 102 transmits data to external devices such as an information processing device via a communication network.

The image reader 11 generates image data by optically reading the image written on a sheet of paper (hereinafter, simply as a sheet). Specifically, light is directed onto the sheet and the reflected light is received by a sensor such as a charge-coupled device (CCD) or a contact image sensor (CIS), thereby reading image data. The image data is information representing an image to be formed on the recording medium such as a sheet and is represented using electrical color-decomposed image signals showing red (R), green (G), and blue (B) colors.

The image reader 11 includes a contact glass 111 and a sensor 112 as illustrated in FIG. 1. The sheet of paper carrying an image thereon is placed on the contact glass 111. The sensor 112 reads out image data of the image carried on the sheet placed on the contact glass 111.

The image forming portion 12 forms a toner image on a surface of the intermediate transfer belt 143 included in the transfer portion 14 by adhering toner on the surface thereof based on the image data read by the image reader 11 or the image data received by the network I/F 102.

The image forming portion 12 includes an image forming unit 120C to form a toner image using a developer including toner having cyan (C) color, an image forming unit 120M to form a magenta (M) toner image using magenta color of toner, an image forming unit 120Y to form a yellow (Y) toner image using yellow color of toner, an image forming unit 120K to form a black (K) toner image using black color of toner, and an image forming unit 120T to form a clear (T) toner image using clear color of toner.

Hereinafter, any one of the C-color toner, M-color toner, Y-color toner, and K-color toner will be denoted as colored toner. Each colored toner is formed of electrically chargeable resin particles including colorant or dye.

By contrast, the clear toner is colorless, transparent toner, and if adhered on the colored toner adhered on the recording medium, the colored toner can be recognized visually. Similarly, if the clear color is adhered on the recording medium, the recording medium can be recognized. The clear toner is generated such that silica dioxide ($SiO_2$) or titanium dioxide ($TiO_2$) is added to polyester resins of a low molecule amount. The clear toner may include a colorant if its amount is within a level that allows the recording medium or the colored toner adhered on the recording medium to be viewable through the clear toner.

Hereinafter, an arbitrary one of the image forming unit 120C, the image forming unit 120M, the image forming unit 120Y, the image forming unit 120K, and the image forming unit 120T will be selected to describe the image forming unit 120.

The image forming unit 120C includes a developer container 121C, a photoreceptor drum 122C, a charger 123C, an exposure device 124C, a developing device 125C, a discharger 126C, and a cleaner 127C.

The developer container 121C contains toner of C-color and supplies C-color toner to the developing device 125C. The developer container 121C includes a conveyance screw to agitate the toner. The toner contained in the developer container 121C is supplied to the developing device 125C by a predetermined amount agitated and defined by a drive of the conveyance screw. A surface of the photoreceptor drum 122C is charged by the charger 123C uniformly. An electrostatic latent image is formed on the charged surface of the photoreceptor drum 122C by the exposure device 124C based on image data received from the control circuit portion 10. Then, the developing device 125C adheres toner on the surface of the photoreceptor drum 122C on which the electrostatic latent image is formed, thereby forming a toner image. The photoreceptor drum 122C is disposed to contact an intermediate transfer belt 143 and rotates in the same direction as that of the intermediate transfer belt 143 at a contact portion with the intermediate transfer belt 143.

The charger 123C uniformly charges the surface of the photoreceptor drum 122C. The exposure device 124C radiates light, based on a halftone dot area ratio determined by the control circuit portion 10, to the surface of the photoreceptor drum 122C charged by the charger 123C, thereby forming the electrostatic latent image. The developing device 125C adheres C-color toner contained in a developer container 121C to the electrostatic latent image formed by the exposure device 124C on the surface of the photoreceptor drum 122C, so that the electrostatic latent image is developed and a toner image is formed.

The discharger 126C electrically neutralizes the surface of the photoreceptor drum 122C after the toner image is transferred to the intermediate transfer belt 143. The cleaner 127C removes residual toner remaining on the photoreceptor drum 122C neutralized by the discharger 126C.

The image forming unit 120M includes a developer container 121M, a photoreceptor drum 122M, a charger 123M, an exposure device 124M, a developing device 125M, a discharger 126M, and a cleaner 127M. The developer container 121M contains M-color toner. Description of the photoreceptor drum 122M, the charger 123M, the exposure device 124M, the developing device 125M, the discharger 126M, and the cleaner 127M is omitted because they are similar to the photoreceptor drum 122C, the charger 123C, the exposure device 124C, the developing device 125C, the discharger 126C, and the cleaner 127C, respectively.

The image forming unit 120Y includes a developer container 121Y, a photoreceptor drum 122Y, a charger 123Y, an exposure device 124Y, a developing device 125Y, a discharger 126Y, and a cleaner 127Y. The developer container 121Y contains Y-color toner. Description of the photoreceptor drum 122Y, the charger 123Y, the exposure device 124Y, the developing device 125Y, the discharger 126Y, and the cleaner 127Y is omitted because they are similar to the photoreceptor drum 122C, the charger 123C, the exposure device 124C, the developing device 125C, the discharger 126C, and the cleaner 127C, respectively.

The image forming unit 120K includes a developer container 121K, a photoreceptor drum 122K, a charger 123K, an exposure device 124K, a developing device 125K, a discharger 126K, and a cleaner 127K. The developer container 121K contains K-color toner. Description of the photoreceptor drum 122K, the charger 123K, the exposure device 124K, the developing device 125K, the discharger 126K, and the cleaner 127K is omitted because they are similar to the photoreceptor drum 122C, the charger 123C, the exposure device 124C, the developing device 125C, the discharger 126C, and the cleaner 127C, respectively.

The image forming unit 120T includes a developer container 121T, a photoreceptor drum 1221, a charger 123T, an exposure device 124T, a developing device 125T, a discharger 126T, and a cleaner 127T. The developer container 121T contains clear toner. Description of the photoreceptor drum 122T, the charger 123T, the exposure device 124T, the developing device 125T, the discharger 126T, and the cleaner 127T is omitted because they are similar to the photoreceptor drum 122C, the charger 123C, the exposure device 124C, the developing device 125C, the discharger 126C, and the cleaner 127C, respectively.

Hereinafter, an arbitrary one of the developer container 121C, the developer container 121M, the developer container 121Y, the developer container 121K, and the developer container 121T will be selected to describe the developer container 121. Further, an arbitrary one selected from the photoreceptor drum 122C, the photoreceptor drum 122M, the photoreceptor drum 122Y, the photoreceptor drum 122K, and the photoreceptor drum 122T is represented as the photoreceptor drum 122. In addition, an arbitrary one selected for describing the charger 123C, the charger 123M, the charger 123Y, the charger 123K, and the charger 123T is represented as the charger 123. In addition, an arbitrary one selected for describing the exposure device 124C, the exposure device 124M, the exposure device 124Y, the exposure device 124K, and the exposure device 124T is represented as the exposure unit 124. Further, an arbitrary one of the developing device 125C, the developing device 125M, the developing device 125Y, the developing device 125K, and the developing device 125T will be selected to describe the developing device 125. In addition, an arbitrary one selected for describing the charger 123C, the charger 123M, the charger 123Y, the charger 123K, and the charger 123T is represented as the charger 123. Furthermore, an arbitrary one selected for describing the cleaner 127C, the cleaner 127M, the cleaner 127Y, the cleaner 127K, and the cleaner 127T is represented as the cleaner 127.

The sheet feeder portion 13 supplies sheets to the transfer portion 14. The sheet feeder portion 13 includes a sheet container 131, a sheet feed roller 132, a sheet feed belt 133, and a registration roller pair 134.

The sheet container 131 contains sheets of paper as an example of recording medium. The sheet feed roller 132 is disposed rotatably to move the sheet contained in the sheet container 131 toward the sheet feed belt. The sheet feed roller 132 is configured to pull out a topmost sheet one by one from the contained and stacked sheets and place the sheet on the sheet feed belt 133.

The sheet feed belt 133 conveys each separated sheet by the sheet feed roller 132 to the transfer portion 14. The registration roller pair 134 sends a sheet conveyed by the sheet feed belt 133, to the transfer portion 14 at a timing when the toner image formed on the intermediate transfer belt 143 arrives at the transfer portion 14, which will be described later.

The transfer portion 14 transfers an image formed on the photoreceptor drum 122 by the image forming portion 12 onto the intermediate transfer belt 143 (i.e., a primary transfer process), and then, the transfer portion 14 transfers the image transferred to the intermediate transfer belt 143 onto the sheet and the like (i.e., a secondary transfer process).

The transfer portion 14 includes a drive roller 141, a driven roller 142, the intermediate transfer belt 143, primary transfer rollers 144C, 144M, 144Y, 144K, and 144T, a secondary transfer roller 145, and a secondary transfer counter roller 146.

The intermediate transfer belt 143 is stretched around the drive roller 141 and the driven roller 142. Thus, when the drive roller 141 is driven and rotates, the intermediate transfer belt 143 stretched around the drive roller 141 moves. The driven roller 142 rotates together when the drive roller 141 rotates and the intermediate transfer belt 143 moves.

The intermediate transfer belt 143 is stretched around the drive roller 141 and the driven roller 142 and moves while contacting the photoreceptor drum 122 as the drive roller 141 rotates. Because the intermediate transfer belt 143 moves while contacting the photoreceptor drum 122, the image formed on the photoreceptor drum 122 is transferred to the surface of the intermediate transfer belt 143.

The primary transfer rollers 144C, 144M, 144Y, 144K, and 144T are disposed opposite the photoreceptor drum 122C, 122M, 122Y, 122K, and 122T, respectively, with the photoreceptor drum 122C, 122M, 122Y, 122K, and 122T sandwiched in between and rotate to move the intermediate transfer belt 143. A secondary transfer roller 145 sandwiches the intermediate transfer belt 143 together with the secondary transfer counter roller 146 to form a secondary transfer nip. The secondary transfer roller 146 sandwiches the intermediate transfer belt 143 and a sheet together with the secondary transfer roller 145.

The fixing portion 15 fixes the toner transferred onto the sheet by the transfer portion 14. Fixation means that the resinous component of toner is fused onto the sheet by applying heat and pressure to the toner on the sheet. The toner transferred onto the sheet by the transfer portion 14 is subjected to the fixing process by the transfer portion 14, so that the toner on the sheet turns into a stabilized state.

The fixing portion 15 includes a conveyance belt 151, a fixing belt 152, a fixing roller 153, a fixing belt conveyance roller 154, a fixing counter roller 155, and a heat generator 156.

The sheet conveyance belt 151 conveys the sheet on which the toner image is transferred in the transfer portion 14, toward the fixing roller 153 and the fixing counter roller 155. The fixing belt 152 is stretched around the fixing roller 153 and the fixing belt conveyance roller 154 and rotates driven by the above rollers 153 and 154. The fixing roller 153 disposed opposite the fixing counter roller 155 sandwiches the sheet conveyed along the conveyance belt 151, which is heated and pressed between the fixing roller 153 and the fixing counter roller 155.

The fixing belt 152 is wound around the fixing belt conveyance roller 154 together with the fixing roller 153, and when the fixing belt conveyance roller 154 rotates, the fixing belt 152 is moved. The fixing counter roller 155 is disposed opposite the fixing roller 153 and sandwiches the conveyed sheet between the fixing roller 153 and the fixing counter roller 155 via the fixing belt 152.

The heat generator 156 disposed inside the fixing roller 153 generates heat and heats the sheet via the fixing roller 153.

The discharging portion 16 discharges the sheet on which the toner image is fixed in the fixing portion 15, from the image forming apparatus 1, and includes a sheet discharge belt 161, a sheet discharge roller 162, a sheet discharge port 163, and a sheet container 164.

The sheet discharge belt 161 conveys the sheet processed in the fixing portion 15 toward the sheet discharge port 163. The sheet discharge roller 162 discharges the sheet conveyed by the sheet discharge belt 161 through the sheet discharge port 163 and contains it in the sheet container 164. The sheet container 164 contains the sheet discharged by the sheet discharge roller 162.

A console 17 includes a control panel 171 and an operation portion 172. The control panel 171 shows settings, menus, and the like. The control panel 171 includes a touch panel to receive key inputs of a user or an operator. The operation portion 172 provides for the user ten keys to input various conditions related to the formation of an image, an instruction to start printing or copying, and the like.

The color printer according to the present embodiment is provided with a replaceable supply-toner conduit 200 (see FIG. 9) from a toner bottle containing toner or a toner cartridge to the developing unit. As a result, because the supply-toner conduit 200 is replaceable, image formation can be enabled with different types of toner.

However, in the replacement of the type of toner, if some or all of the components constructing the supply-toner conduit 200 are wrongly installed, color mixing of different type of toner or contamination may occur.

As a countermeasure, the present embodiment enables identification of the type of toner in the supply-toner conduit 200. As a method of identifying the toner type in the supply-toner conduit, toner type information is added to the supply-toner conduit and the image forming apparatus is configured to read and determine the toner type information of the supply-toner conduit 200.

Specifically, an ID chip formed of, for example, a nonvolatile memory is mounted in the device forming the supply-toner conduit 200, and the image forming apparatus reads out the toner type information stored in the ID chip. Determination of the toner type information can be performed by a control means or a toner type identifier included in the image forming apparatus. Then, the toner type information may be added to some or all of the devices constructing the supply-toner conduit 200.

When the supply-toner conduit 200 is replaced to replace the toner type, by reading the toner type information added to the supply-toner conduit 200 from the image forming apparatus, whether or not the supply-toner conduit 200 is appropriate can be determined so that color mixing of different toner may be prevented from occurring. The CPU 1011 in the control circuit as illustrated in FIG. 2 performs the toner type identifier. The other CPU may serve as the toner type identifier.

Reading and writing of the toner type information from and to a Radio Frequency Identification chip (RFID) attached to the toner bottle in the present embodiment will now be described.

Figure 3:
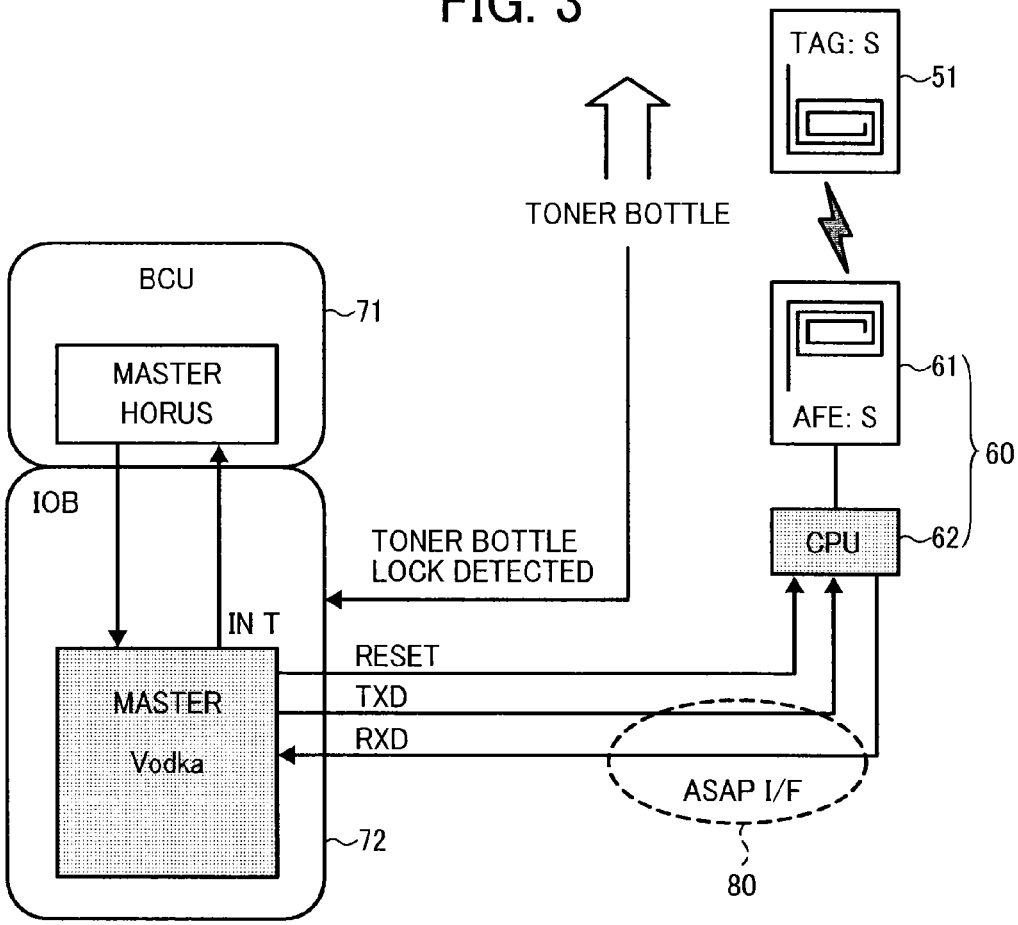
FIG. 3 is a block diagram illustrating a configuration to enable communication between a toner bottle and the image forming apparatus.

FIG. 3 is a block diagram illustrating a communication with an RFID tag attached to the toner bottle. Herein, the toner color to be contained in the toner bottle is described as S-color.

For access to the RFID tag 51 of the toner bottle, a communication portion 60 includes one piece of IC board 61 embedded with an antenna and 1-channel modem IC (hereinafter, to be referred to as an Analog Front End or AFE) and another piece of IC board 62 embedded with a CPU, so that reading and writing to a memory of the RF tag embedded with the S-color toner bottle (not shown) is enabled. The communication portion 60 is connected to the image forming apparatus 1 (that includes a bus control unit or BCU 71 and an input-output buffer or ICB 72) via the ASAP interface 80 and transmits command data.

Master Vodka of the IOB 72 communicates with the CPU (RFID_RW) 62 via the ASAP interface 80 and transmits command data through serial communication at 9600 bps.

The CPU (RFID_RW) 62 resets the CPU by a port reset (M_Vodka).

Further, the CPU (RFID_RW) 62 analyses the ASAP command via an internal processing and performs data code conversion (Mirror code conversion).

Commands and data between the CPU 62 and the AFE (RFID_RW) are transmitted by the serial communication at 106 kbps (13.56 MHz).

The transmitted data is amplitude-shift keying (ASK) modulated by the AFE (RFID_RW) of the circuit board 61 and is read and written (Read/Write) from and to the RF tag 51 via a carrier wave of 13.56 MHz with a bit rate of 26 kbps.

Heretofore, an exemplary structure to provide the toner bottle with toner type information has been described; however, devices other than the toner bottle forming the supply-toner conduit 200 may have the toner type information in a similar way.

Figure 4:
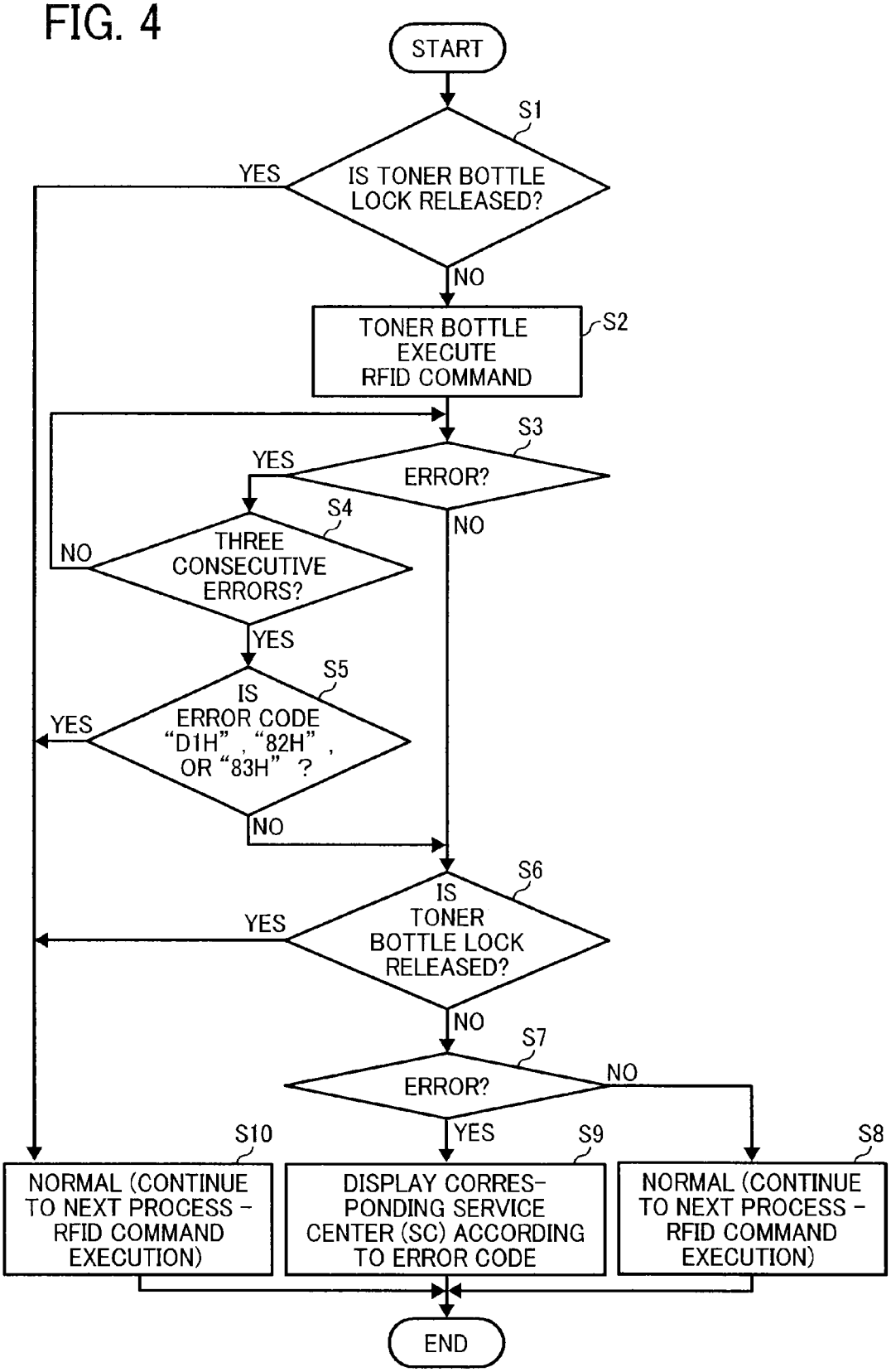
FIG. 4 is a flowchart illustrating an activation process of an ID chip installed in the toner bottle.

FIG. 4 is a flowchart illustrating an activation (or reset) process of a RFID chip attached to the toner bottle.

The reset process of the CPU (RFID_RW) 62 is as illustrated in the flowchart of FIG. 4. In RFID communication, determination results of "locked" and "lock released" of the toner bottle are obtained immediately before and after (S1 and S6) the RFID command execution (S2). Immediately after the command execution, the presence or absence of RFID response error is determined in S3, but without depending on the determination result, the "locked" or "lock released" of the toner bottle is obtained. Then, depending on the determination result of the presence or absence of the error and that of the "locked" or "lock released" of the toner bottle, whether the status is normal (S8); abnormal, should call a service person (S9); and toner bottle not set (S10) is determined.

Figure 5:
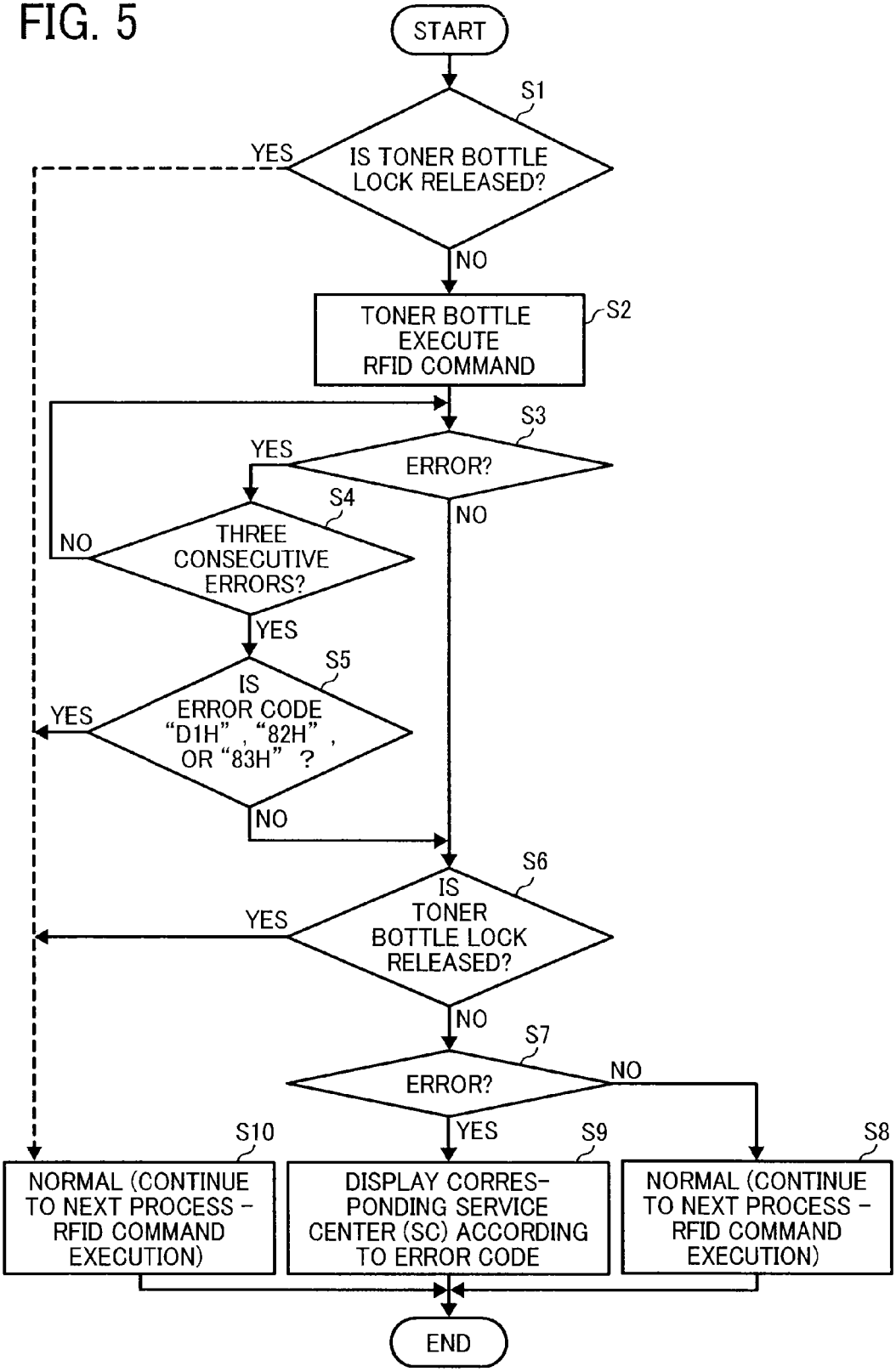
FIG. 5 is a flowchart illustrating a process flow when a toner bottle is not installed.
Figure 6:
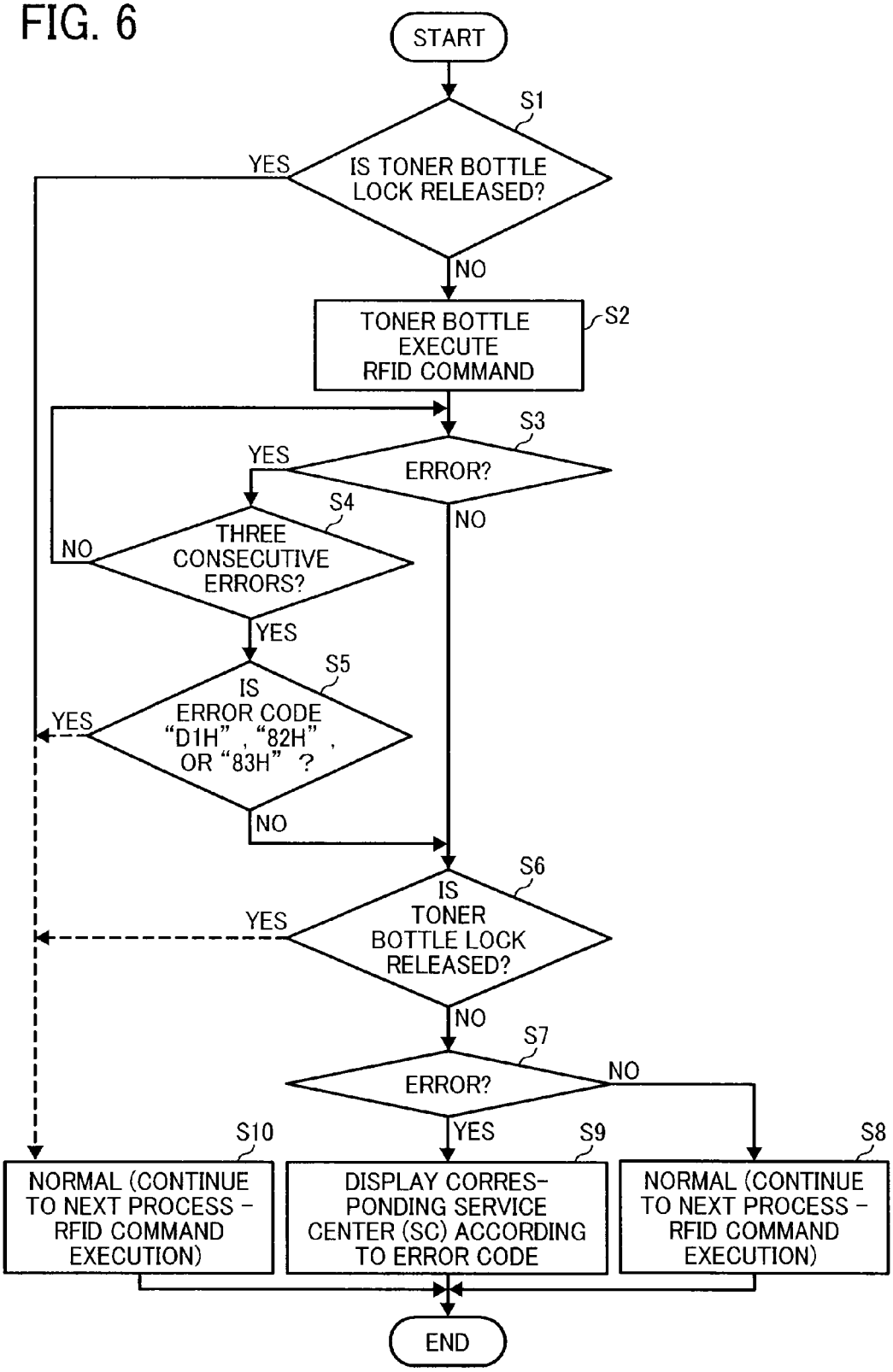
FIG. 6 is a flowchart illustrating another process flow when a toner bottle is not installed.

If the toner bottle is not set, it is determined that the toner bottle is not set in either route of Pattern A in FIG. 5 and Pattern B in FIG. 6.

Figure 7A:
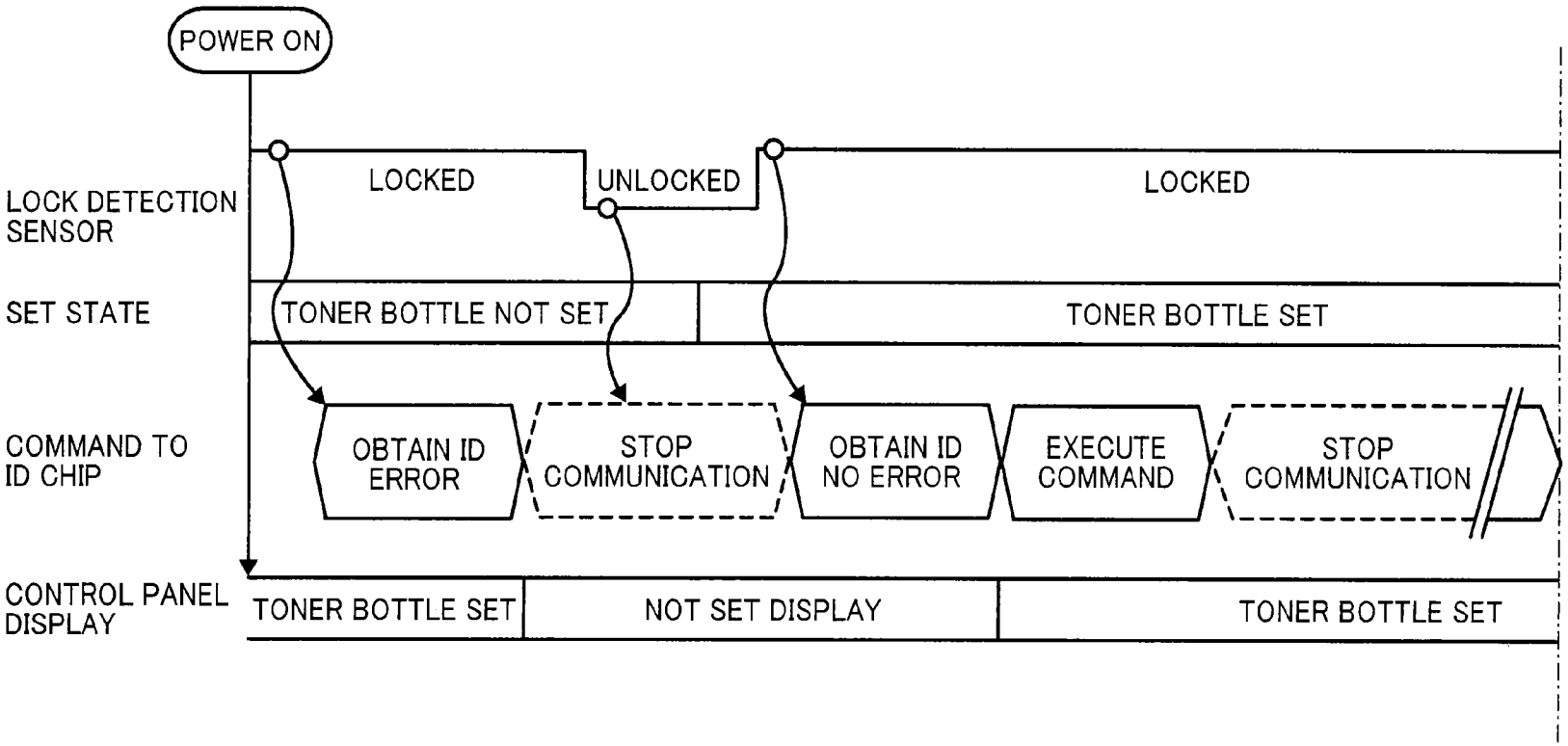
FIGS. 7A and 7B show a transition, after activation, of the toner bottle from a set state, to a not-set state, and back to a set state again.
Figure 7B:
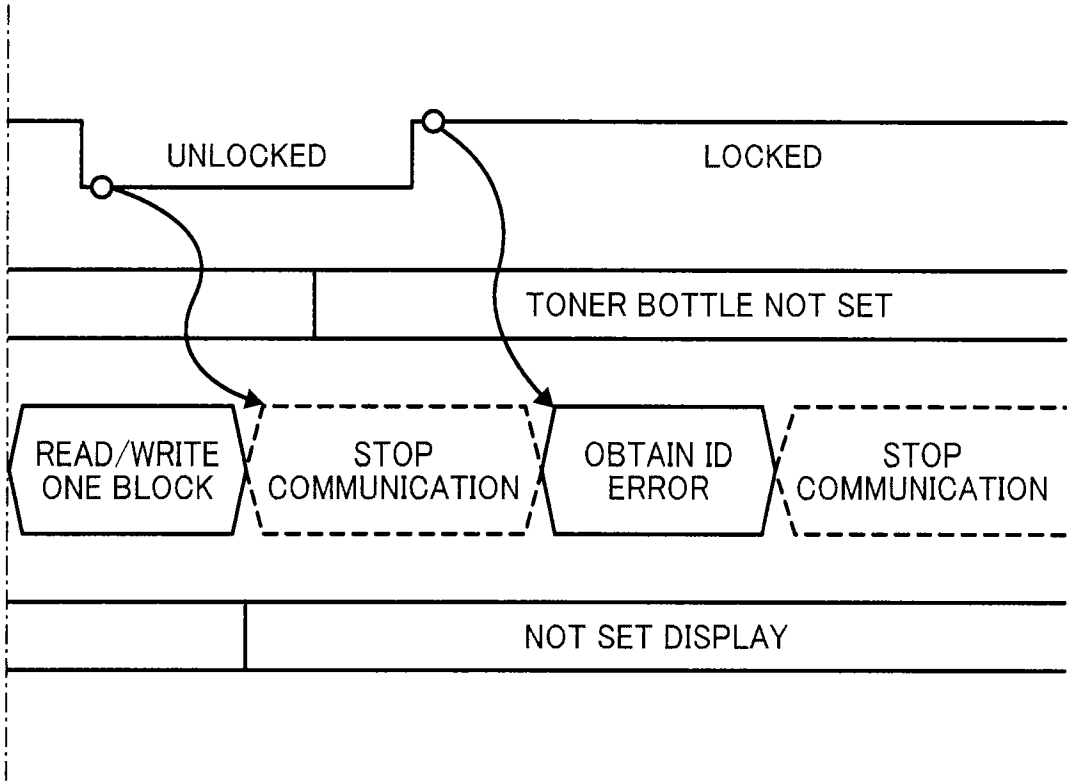

FIGS. 7A and 7B show a transition of a state in which, after activation, the toner bottle transits from a not-set state to a set state and again to the not-set state.

Next, necessity of the cleaning or replacement of the supply-toner conduit 200 will be described.

In general, toner is conveyed through various supply-toner conduits 200 from the toner bottle or toner cartridge to the developing unit, which include a supply tube, pump, hopper, and the like. Because the supply-toner conduit 200 includes used toner, without appropriately cleaning or replacing the toner in the supply-toner conduit 200 with a fresh one, toner color mixing occurs at replacement. A direct toner supply method is a method to supply toner directly from the toner bottle to the developing unit without passing through the supply-toner conduit 200. In this case, the supply-toner conduit 200 need not be cleaned nor replaced.

Figure 8:
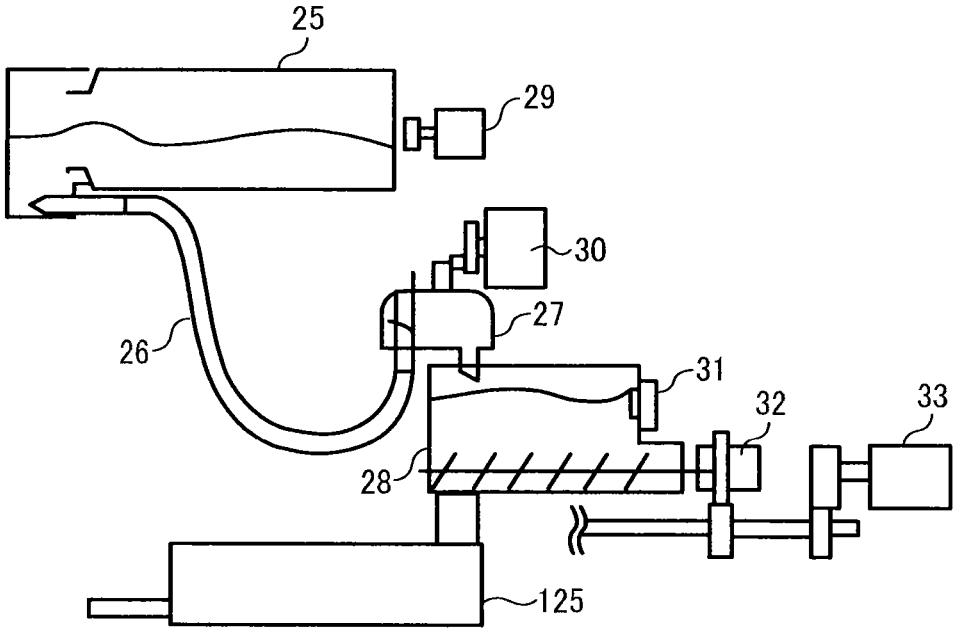
FIG. 8 illustrates each device related to toner supply from the toner bottle to the developing unit.
Figure 9:
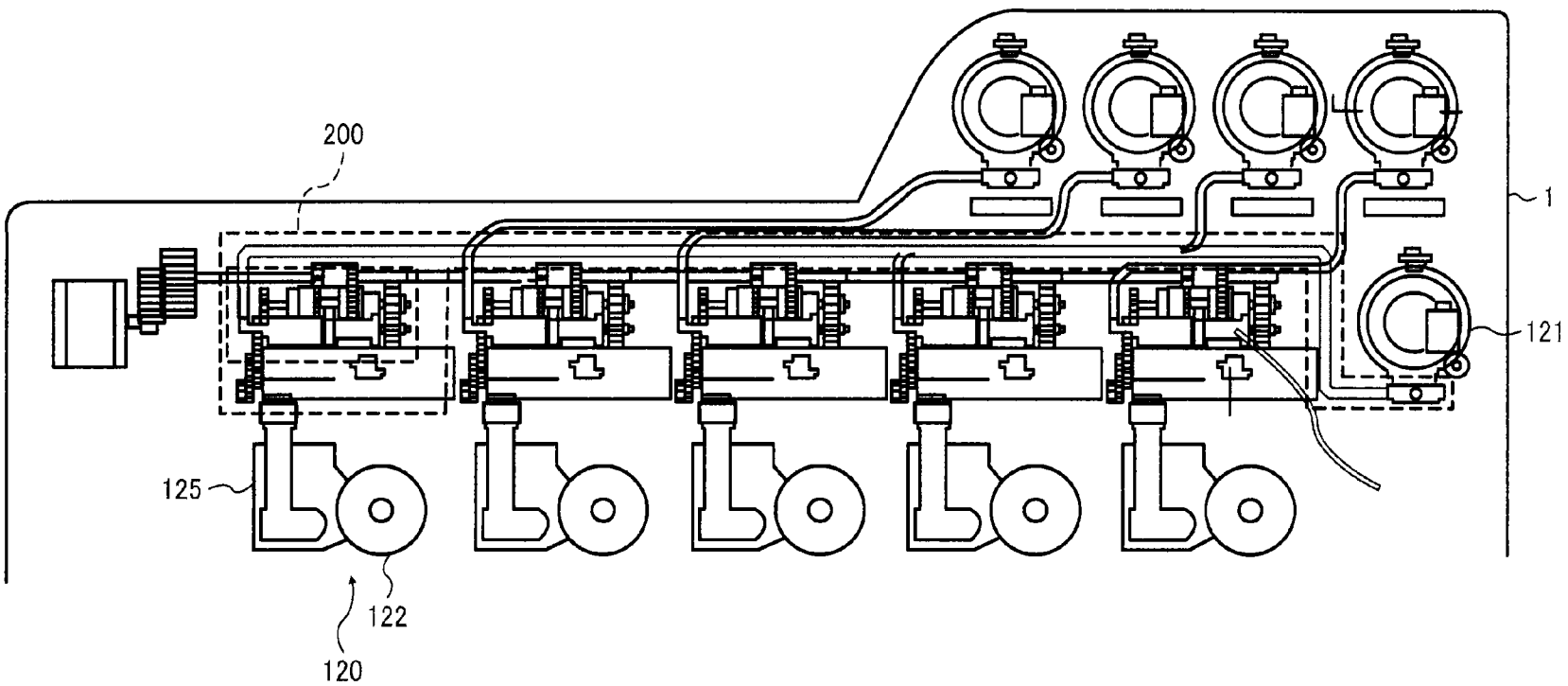
FIG. 9 illustrates image forming stations and toner bottles installed in the image forming apparatus.

Referring to FIGS. 8 to 10, a structure in which the supply-toner conduit 200 includes the toner bottle, supply tube, pump, hopper, and developing unit will be described.

FIG. 8 illustrates each device related to supplying toner to the developing unit 125. In the illustrated structure, toner is conveyed from a toner bottle (RTC bottle) 25 via a conveyance tube 26 and a pump 27 to a hopper 28, and further to a developing unit 125. Further, devices related to supplying toner to the developing unit 125 include: a bottle drive motor 29 to rotate the toner bottle 25; a diaphragm pump motor 30 that supplies toner to the hopper 28; a toner end sensor 31 to detect whether toner exists or not in the hopper 28; a supply clutch 32; and a supply motor 33 to drive a supply screw in the hopper 28.

As illustrated in FIG. 9, the image forming apparatus according to the present embodiment includes five image forming stations or units 120. First, from an image forming station of which toner type is to be changed, all or any of the toner bottle, tube, pump, hopper, and developing unit is removed. The supply-toner conduit 200 as a target for removal between the toner bottle and the developing unit is shown by a broken line in FIG. 9.

Figure 10A:
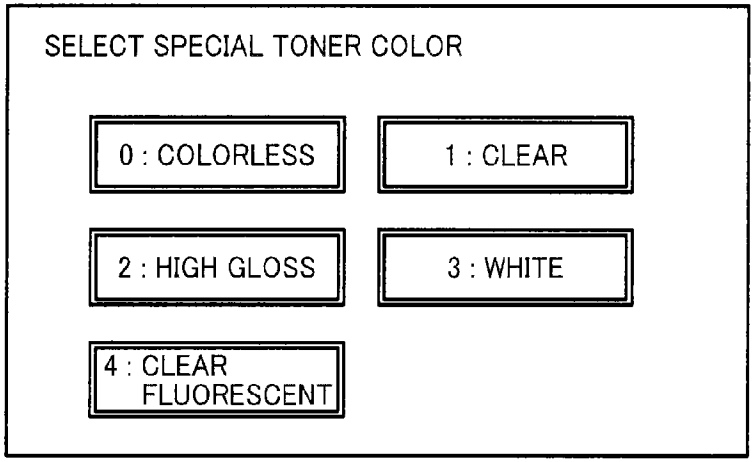
FIGS. 10A to 10D show examples of displays on a control panel related to a special toner selection and error messages.

When all or any of the toner bottle, tube, pump, hopper, and developing unit included in the target image forming station of which toner type is to be changed is removed, as illustrated in FIG. 10A, a toner type to be replaced is designated on the control panel or digital front end. The toner type is recorded in the memory of the image forming apparatus corresponding to the toner type designated at that time. Next, the image forming apparatus is shut down.

Then, in a power-off state of the image forming apparatus, all or any of the toner bottle, tube, pump, hopper, and developing unit is mounted on the apparatus body.

Then, the image forming apparatus is turned on and whether all the supply-toner conduit 200 is mounted or not is determined.

Figure 10B:
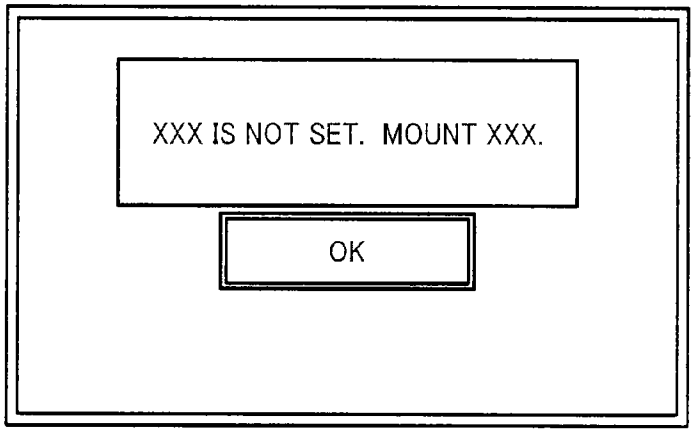

If all the supply-toner conduit 200 is not mounted, an instruction to mount all the supply-toner conduit 200 is displayed on the control panel or the digital front end (FIG. 10B. In response to the instruction, the user turns off the power of the image forming apparatus again, mounts the target supply-toner conduit 200 on the apparatus, and again turns on the apparatus. In addition, when the supply-toner conduit 200 is all mounted, the process moves on to a next step.

Next, whether or not the toner type information of the supply-toner conduit 200 mounted in the apparatus meets that of the image forming apparatus is determined.

Figure 10C:
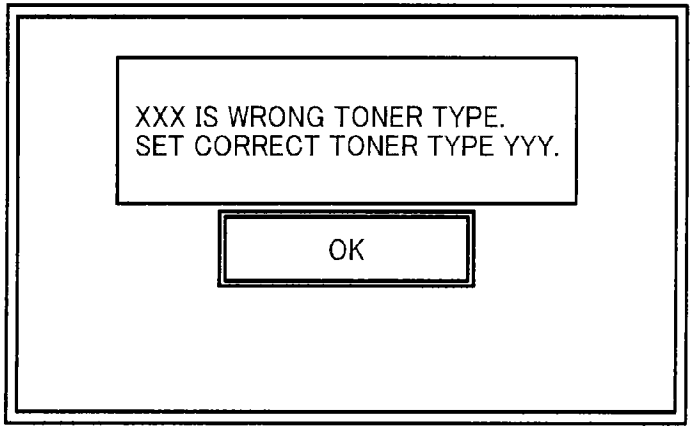

If the toner type information of all the supply-toner conduit 200 does not match that of the image forming apparatus, a notification that the toner type information of all the supply-toner conduit 200 does not match that of the image forming apparatus is input on the control panel or the digital front end (FIG. 10C). In response to the instruction, the user turns off the power of the image forming apparatus again, mounts the target supply-toner conduit 200 in the apparatus, and again turns on the apparatus.

Figure 10D:
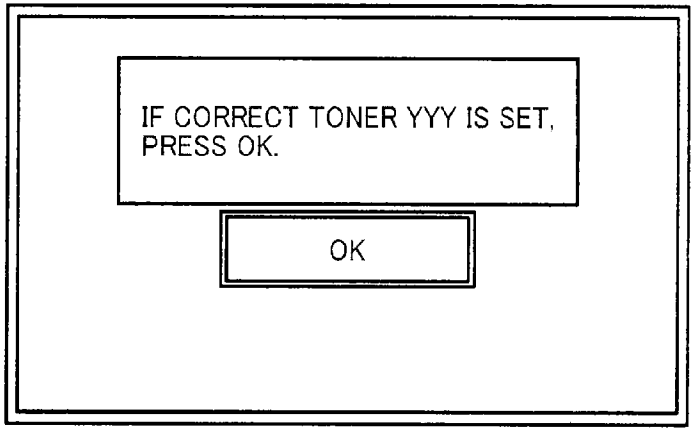

If it is determined that the toner type information of the supply-toner conduit 200 and that of the image forming apparatus match, the image forming apparatus is activated to be ready for image formation (FIG. 10D).

Figure 11:
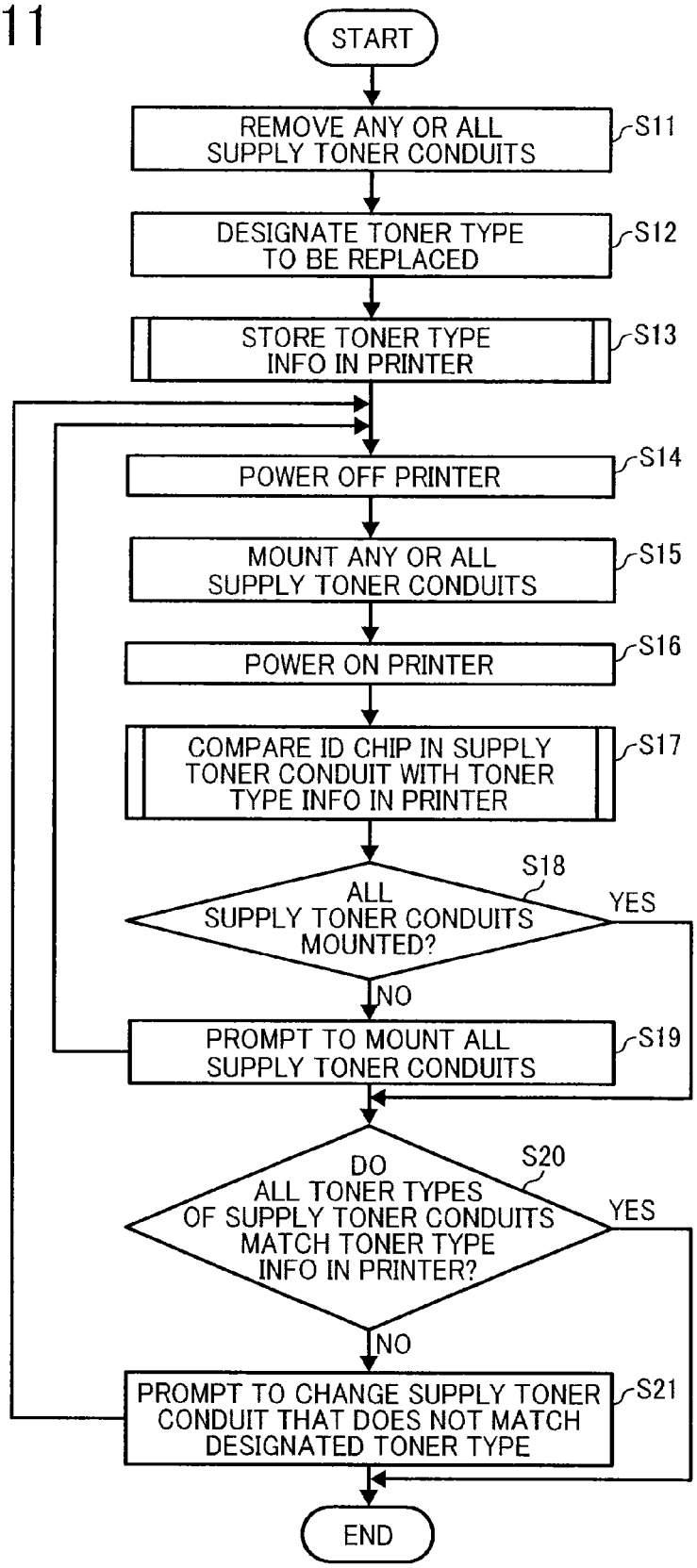
FIG. 11 is a flowchart illustrating a replacement process of a supply-toner conduit when the toner type is changed.

FIG. 11 is a flowchart illustrating replacement of the supply-toner conduit 200 in changing the toner type. The description of the flowchart is omitted because it is similar to the aforementioned.

Thus, in the image forming apparatus according to the present embodiment, the supply-toner conduit 200 is replaceably provided and the toner type is recognized or identified by the supply-toner conduit 200. As a result, different types of toner can be replaced and used, so that the clear toner or the special toner can be used.

Moreover, erroneous assembly of the devices forming the supply-toner conduit 200 can be prevented in the replacement work of the different type of toner, so that an undesired color mixing of the different type of toner or contamination can be prevented from occurring. With this configuration, abnormal images or damage to the image forming unit can be prevented.

The image forming apparatus according to the present embodiment can be configured such that the toner type can be changed by replacing some or all of the components forming the supply-toner conduit 200. In the latter case, by replacing a necessary part alone, the toner type can be changed.

In addition, by storing toner type information in memory means such as RFID chip, the information can electronically be rewritten.

If there is a concern that color mixing occurs due to erroneous assembly of the device or that a part of the devices is left uninstalled, when the image forming apparatus is controlled to stop its operation, all the image forming operation is stopped, resulting in acute degradation of productivity and user convenience.

Then, if the control is configured such that the image forming station having no abnormality alone may operate, degradation of productivity can be restricted and the user convenience can be retained.

Hereinafter, image forming operation during an exclusive control in which only the image forming station with no abnormality is allowed to perform an image forming operation will be described.

Specifically, in the exclusive control, if the toner type is not the same in all the devices forming the supply-toner conduit 200 relative to a certain image forming station, the image forming operation is prohibited. However, the image forming operation is allowed in the image forming station that is not a target of the exclusive control.

When image data to be printed by a printing or copying is input to the image forming apparatus, the image data is color-decomposed and the image forming station for use in the printing or copying is designated. If the designated image forming station includes such an image forming station of which toner type is not the same with each device forming the supply-toner conduit 200, a notice that a part of the image forming station is not useable is notified to a user via the control panel or the digital front end. If the user agrees, image formation is performed not using all the image forming stations. If the user does not agree, a replacement process of the different toner type in the supply-toner conduit 200 will be performed.

Figure 12:
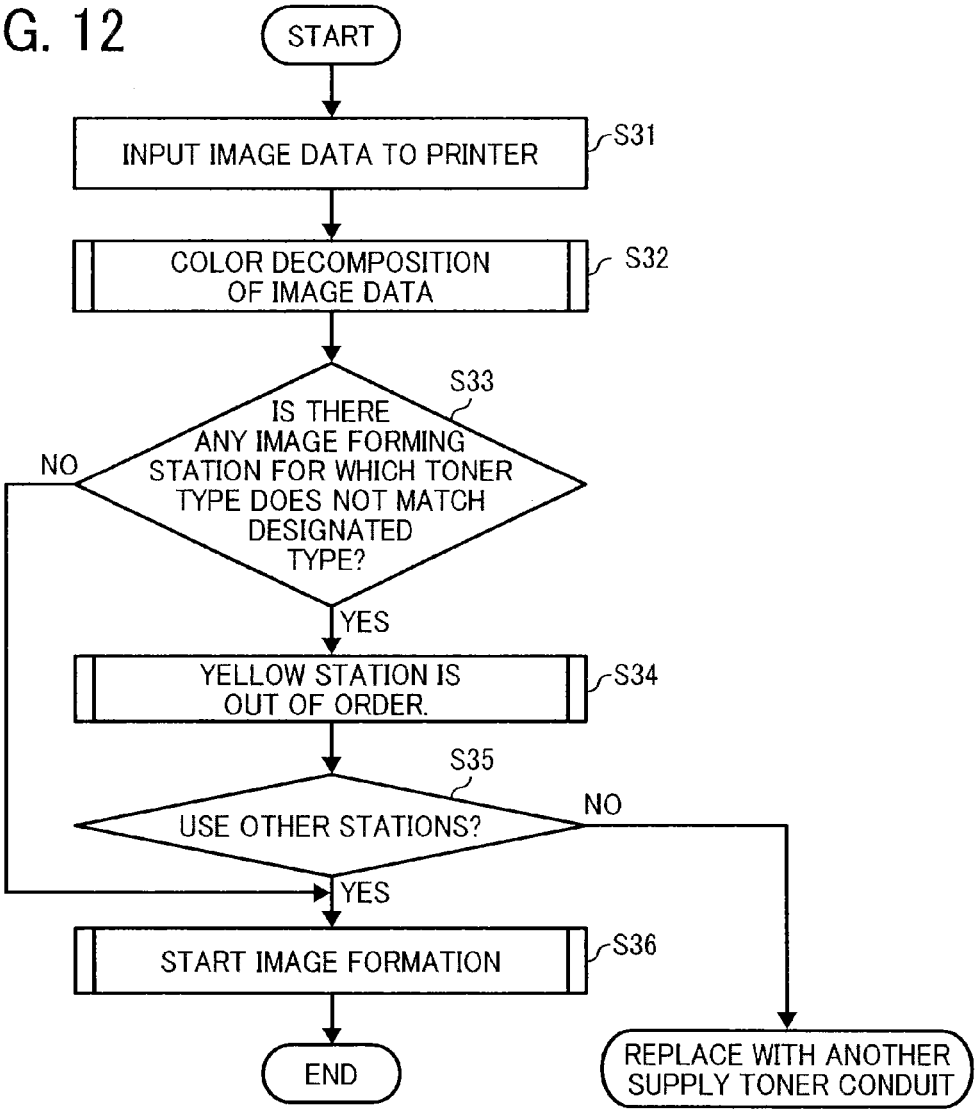
FIG. 12 is a flowchart illustrating control of the image forming operation in the exclusive control.
Figure 13:
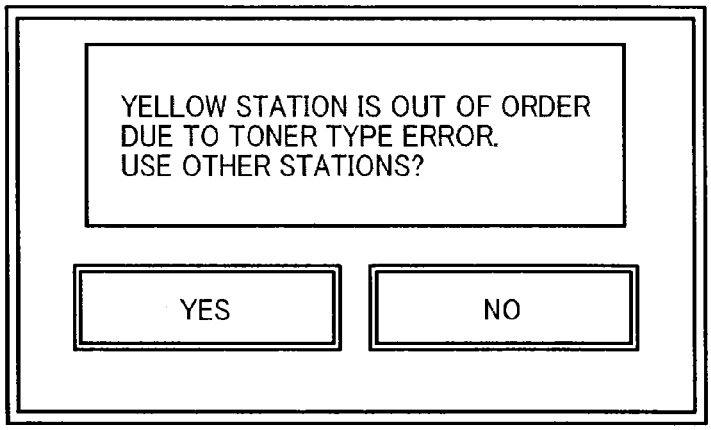
FIG. 13 is an error message issued when any of the image forming stations cannot perform printing.

FIG. 12 is a flowchart to show the exclusive control as described above. FIG. 13 is an exemplary notice in step S34 in the flowchart of FIG. 12. XXX in FIG. 13 shows a name of the supply-toner conduit 200. For example, if the target for the exclusive control is the yellow image forming station 120Y, the instruction reads: "Yellow station is out of order due to toner type error. Use other stations?" Due to such control, the user's request for printing can be satisfied.

As such, when in any (one or plural) image forming stations, a state in which the toner type is not the same in all the devices forming the supply-toner conduit 200 occurs (this state is denoted as color mixing occurrence), the image forming operation is allowed to use the image forming stations other than the image forming station in which color mixing occurs, thereby preventing color mixing of different type of toner that the user does not intend, and the resulting contamination. Thus, while preventing the productivity from degrading, the user convenience is optimally retained.

Further, the image forming apparatus according to the present embodiment includes plural image forming stations, of which toner type information can be added to the supply-toner conduit 200 of all the stations among plural image forming stations; or alternatively, the toner type information can be added to the supply-toner conduit 200 of an arbitrary station of the plural image forming stations. In the latter case, using the image forming station added with the toner type information alone, replacement of the toner type can be performed, thereby reducing the cost.

The station to which the toner type information can be added may be user selectable. In this case, the station to which the toner type information is added can be designated by an input on the control panel or the digital front end. With such a structure, whether the toner type information is to be added or not is selectable for each supply-toner conduit 200 or each image forming station.

Heretofore, the present invention has been described with reference to drawings, but is not limited to the aforementioned embodiments alone. For example, the number of the image forming stations is not limited to five, and four or six image forming stations may be configured in the image forming apparatus. The types of special toner including the clear toner for use may also be selectable.

Furthermore, an arrangement order of each of the image forming stations or units in the tandem-method image forming apparatus is not limited to the illustrated embodiments. The transfer method is not limited to the intermediate transfer method, but the direct transfer method may be employed. Disposition of the image forming stations is not limited to the tandem method, neither. Structure of each divisional part and component included in the image forming apparatus is not limited to the illustrated examples. The image forming apparatus may be a printer, a copier, a facsimile machine, or a multifunctional device including plural capabilities as described above.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a plurality of image forming stations, each including a developing device, a toner container containing a colored or special toner, and a replaceable supply-toner conduit extending from the toner container to the developing device; and a toner type identifier provided to the replaceable supply-toner conduit, to identify a type of toner used in the supply-toner conduit of each of the plurality of image forming stations.

2. The image forming apparatus as claimed in claim 1, further comprising a memory device that stores toner type information to be added to the supply-toner conduit, wherein the toner type identifier reads the toner type information added to the supply-toner conduit to identify the type of toner in the supply-toner conduit.

3. The image forming apparatus as claimed in claim 2, wherein the memory is a RF chip.

4. The image forming apparatus as claimed in claim 2, wherein the toner type identifier determines whether the supply-toner conduit is mounted or not in the image forming apparatus.

5. The image forming apparatus as claimed in claim 2, wherein the toner type identifier determines whether or not some or all of components forming the supply-toner conduit are mounted in the image forming apparatus.

6. The image forming apparatus as claimed in claim 5, wherein, when the toner type identifier determines that the type of toner is not the same in all the components forming the supply-toner conduit in at least one of the plurality of image forming stations, an image forming operation for all the plurality of image forming stations is prohibited.

7. The image forming apparatus as claimed in claim 5, wherein, when the toner type identifier determines that the type of toner is not the same in all the components forming the supply-toner conduit in at least one of the plurality of image forming stations, an image forming operation for the image forming stations other than the at least one of the plurality of image forming stations is allowed.

8. The image forming apparatus as claimed in claim 2, wherein the toner type information to identify the type of toner is added to the supply-toner conduit of an arbitrary one of the plurality of image forming stations.

9. The image forming apparatus as claimed in claim 2, wherein the plurality of image forming stations to which the toner type information for determining the type of toner in the supply-toner conduit is added are selectable.

10. An image forming apparatus comprising:

a plurality of image forming stations, each including a developing device, a toner container containing a toner, wherein certain of the toner containers in the image forming stations contain colored toners and another one of the toner containers in another one of the image forming stations contains a special toner that is not one of the colored toners, and a replaceable supply-toner conduit extending from the toner container to the developing device; and a toner type identifier provided to the replaceable supply-toner conduit, to identify a type of toner used in the supply-toner conduit of each of the plurality of image forming stations, wherein the toner type identifier reads toner type information added to the supply-toner conduit to identify the type of toner in the supply-toner conduit, and wherein, when the toner type identifier determines that the type of toner is not the same in all the components forming the supply-toner conduit in at least one of the plurality of image forming stations, an image forming operation for all the plurality of image forming stations is prohibited.

11. The image forming apparatus as claimed in claim 10, wherein the colored toners are C, M, Y and K colored toners.

12. The image forming apparatus as claimed in claim 10, wherein the special toner is a clear toner.

13. The image forming apparatus as claimed in claim 11, wherein the special toner is a clear toner.

* * * * *